US009381404B2

(12) United States Patent
Fitchett et al.

(10) Patent No.: US 9,381,404 B2
(45) **Date of Patent: *Jul. 5, 2016**

(54) GOLF BALL HAVING AN INCREASED MOMENT OF INERTIA

(75) Inventors: Derek A. Fitchett, Beaverton, OR (US); Nicholas Yontz, Portland, OR (US); Johannes Anderl, Vienna (AT)

(73) Assignee: NIKE, Inc., Beaverton, OR (US)

( * ) Notice: Subject to any disclaimer, the term of this patent is extended or adjusted under 35 U.S.C. 154(b) by 760 days.

This patent is subject to a terminal disclaimer.

(21) Appl. No.: 13/483,862

(22) Filed: May 30, 2012

(65) Prior Publication Data

US 2012/0283043 A1 Nov. 8, 2012

Related U.S. Application Data

(63) Continuation-in-part of application No. 13/184,254, filed on Jul. 15, 2011, and a continuation-in-part of application No. 12/569,955, filed on Sep. 30, 2009, now abandoned.

(51) Int. Cl.

| | |
|---|---|
| ***A63B 37/06*** | (2006.01) |
| ***A63B 37/12*** | (2006.01) |
| ***A63B 37/00*** | (2006.01) |
| ***A63B 45/00*** | (2006.01) |

(52) U.S. Cl.

CPC ..... *A63B 37/12* (2013.01); *A63B 37/0022* (2013.01); *A63B 45/00* (2013.01); *A63B 37/0035* (2013.01)

(58) Field of Classification Search

CPC ..... A63B 37/0005; A63B 37/0022
USPC ..... 473/378
See application file for complete search history.

(56) References Cited

U.S. PATENT DOCUMENTS

| | | | |
|---|---|---|---|
| 3,819,190 | A | 6/1974 | Nepela et al. |
| 4,266,733 | A | 5/1981 | Butler |

(Continued)

FOREIGN PATENT DOCUMENTS

| | | | |
|---|---|---|---|
| CN | 1953790 | A | 4/2007 |
| EP | 2314359 | A1 | 4/2011 |

(Continued)

OTHER PUBLICATIONS

PCT/US2012/046648 International Search Report dated Oct. 5, 2012.
Chinese Patent Application No. 201010295506.1 Second Office Action dated Aug. 31, 2012.
Japanese Patent Application No. 2011-156290 Notice of Reasons for Rejection dated Jun. 19, 2013.

(Continued)

*Primary Examiner* — Raeann Gorden
(74) *Attorney, Agent, or Firm* — Banner & Witcoff, Ltd.

(57) ABSTRACT

A golf ball is provided including a core, a cover encasing the core and a coating that comprises a resin applied to the outer surface of the cover. Particles comprising a high density material are included in the coating such that the coating has a density at least twice that of the core's density or contributes at least 0.60% of the golf ball's total moment of inertia, and the coating has a micro surface roughness at least 1.75 times larger than the roughness of a comparative ball. A method of making a golf ball is also provided, including providing a spherical core, encasing the core with a cover, applying a resin to the outer surface of the cover, and adding a plurality of particles comprising a high density material to form a coating material that has a second density at least two times the first density.

16 Claims, 6 Drawing Sheets

(56) References Cited

U.S. PATENT DOCUMENTS

| | | | |
|---|---|---|---|
| 4,266,773 | A | 5/1981 | Treadwell |
| 4,284,276 | A | 8/1981 | Worst |
| 4,438,924 | A | 3/1984 | Carr |
| 4,987,702 | A | 1/1991 | Anschutz |
| 5,427,378 | A | 6/1995 | Murphy |
| 5,766,097 | A | 6/1998 | Horiuchi et al. |
| 5,830,077 | A | 11/1998 | Yavitz |
| 5,984,806 | A | 11/1999 | Sullivan et al. |
| 6,193,617 | B1 | 2/2001 | Mertens |
| 6,315,681 | B1 | 11/2001 | Sullivan |
| 6,475,106 | B1 | 11/2002 | Green et al. |
| 6,569,038 | B2 | 5/2003 | Sullivan |
| 6,596,837 | B2 | 7/2003 | Hogge et al. |
| 6,729,976 | B2 | 5/2004 | Bissonnette et al. |
| 6,743,123 | B2 | 6/2004 | Sullivan |
| 6,821,191 | B2 | 11/2004 | Lim et al. |
| 6,849,007 | B2 | 2/2005 | Morgan et al. |
| 6,866,802 | B2 | 3/2005 | Puniello et al. |
| 6,902,498 | B2 | 6/2005 | Sullivan et al. |
| 6,908,402 | B2 | 6/2005 | Sullivan et al. |
| 6,919,395 | B2 | 7/2005 | Rajagopalan et al. |
| 6,939,249 | B2 | 9/2005 | Sullivan |
| 6,945,878 | B2 | 9/2005 | Binette et al. |
| 6,991,563 | B2 | 1/2006 | Sullivan et al. |
| 7,115,050 | B2 | 10/2006 | Andre et al. |
| 7,232,384 | B2 | 6/2007 | Sullivan et al. |
| 7,281,997 | B2 | 10/2007 | Kennedy, III et al. |
| 7,388,053 | B2 | 6/2008 | Sullivan et al. |
| 7,534,834 | B2 | 5/2009 | Onoda et al. |
| 8,275,587 | B2 | 9/2012 | Sato et al. |
| 2002/0025864 | A1 | 2/2002 | Barfield |
| 2002/0077195 | A1 | 6/2002 | Carr et al. |
| 2002/0173384 | A1 | 11/2002 | Hogge et al. |
| 2003/0114252 | A1 | 6/2003 | Hayashi |
| 2003/0119608 | A1 | 6/2003 | Hayashi et al. |
| 2003/0148828 | A1 | 8/2003 | Isogawa |
| 2004/0015602 | A1 | 1/2004 | Goldhammer et al. |
| 2004/0052970 | A1 | 3/2004 | Ohira |
| 2004/0053707 | A1 | 3/2004 | Ohira |
| 2004/0087389 | A1 | 5/2004 | Kasashima et al. |
| 2004/0266559 | A1 | 12/2004 | Asakura |
| 2005/0277488 | A1 | 12/2005 | Onoda et al. |
| 2006/0030428 | A1 | 2/2006 | Ohira |
| 2006/0148591 | A1 | 7/2006 | Hebert et al. |
| 2007/0015602 | A1 | 1/2007 | Watanabe |
| 2007/0093318 | A1 | 4/2007 | Bartsch et al. |
| 2007/0213143 | A1 | 9/2007 | Chinn et al. |
| 2008/0064529 | A1 | 3/2008 | Kennedy, III et al. |
| 2008/0220907 | A1 | 9/2008 | Aoyama et al. |
| 2008/0280699 | A1 | 11/2008 | Jarvholm |
| 2009/0111614 | A1 | 4/2009 | Ohira |
| 2010/0037914 | A1 | 2/2010 | Miller |
| 2010/0311521 | A1 | 12/2010 | Ohira |
| 2011/0077106 | A1 | 3/2011 | Fitchett |
| 2011/0136590 | A1 | 6/2011 | Kim et al. |
| 2011/0177885 | A1 | 7/2011 | Ichikawa |
| 2011/0183777 | A1 | 7/2011 | Oh |
| 2011/0190077 | A1 | 8/2011 | Sajima et al. |
| 2013/0104932 | A1 | 5/2013 | Fehsenfeld et al. |
| 2013/0168896 | A1 | 7/2013 | Tutmark |

FOREIGN PATENT DOCUMENTS

| | | | |
|---|---|---|---|
| JP | H07-194733 | | 8/1995 |
| JP | 2002-536136 | A | 10/2002 |
| JP | 2002-369896 | | 12/2002 |
| JP | 2002-543945 | | 12/2002 |
| JP | 2002369896 | A | 12/2002 |
| JP | 200481350 | A | 3/2004 |
| JP | 2004-107485 | A | 4/2004 |
| JP | 2004-130111 | A | 4/2004 |
| JP | 2004-147836 | | 5/2004 |
| JP | 2004-147836 | A | 5/2004 |
| JP | 2005027774 | A | 2/2005 |
| JP | 2006-051357 | A | 2/2006 |
| JP | 2006-075210 | | 3/2006 |
| JP | 2006075210 | A | 3/2006 |
| JP | 08-308958 | A | 11/2006 |
| JP | 2007260317 | A | 10/2007 |
| JP | 2008-161375 | A | 7/2008 |
| JP | 2009-106720 | | 5/2009 |
| JP | 2009106720 | A | 5/2009 |
| WO | 98/43711 | | 10/1998 |
| WO | 00/69526 | | 11/2000 |
| WO | 01/52944 | A1 | 7/2001 |
| WO | 2008/137973 | A1 | 11/2008 |

OTHER PUBLICATIONS

Questioning for corresponding Japanese Patent Application 2010-180877 dated Sep. 26, 2011.

Notification from Japanese Patent Office for corresponding Japanese Patent Application No. 2011-156290 dated Mar. 26, 2012.

Third-Party Submission of Information for corresponding Japanese Patent Application No. 2011-156290 dated Mar. 15, 2012.

Non-Final Office Action for U.S. Appl. No. 12/569,955, mailed Jun. 6, 2012, 27 pages.

PCT/US2012/046750 International Search Report dated Oct. 5, 2012.

Elmar Achenbach (1974), "The Effects of Surface Roughness and Tunnel Blockage on the Flow Past Spheres," J. Fluid Mechanics, vol. 65, part 1, pp. 113-125.

Sajima, T., Yamaguchi, T., Yabu, M., and Tsunoda, M. (2006), The Aerodynamic Influence of Dimple Design on Flying Golf Ball, in Springer (ed.), Engineering of Sport 6, p. 143.

Jin Choi, Woo-Pyung Jeon, and Haecheon Choi (2006), "Mechanism of Drag Reduction by Dimples on a Sphere," by Physics of Fluids 18, pp. 1-4.

Kimura, T. and Tsutahara, M. (1990), "Fluid Dynamic Effects of Grooves on Circular Cylinder Surface," AIAA Journal, vol. 29, No. 12, pp. 2062-2068.

Mehta, R.D. and Pallis, J.M. (2001), "Sports Ball Aerodynamics: Effects of Velocity, Spin, and Surface Roughness," Materials and Science in Sports, TMS, p. 185.

Smits, A.J., and Smith, D.R. (1994), "A New Aerodynamic Model of a Golf Ball in Flight," Science and Golf II: Proceedings of the World Scientific Congress of Golf, London: E & FN Spon.

Ting, L.L. (2003), "Effects of Dimple Size and Depth on Golf Ball Aerodynamic Performance," Proceedings of FEDSM'03 4th ASME_JSME Joint Fluids Engineering Conference, pp. 811-817.

Smith, C., Beratlis, N., Balaras, E., Squires, K., and Tsunoda, M. (2008), "Direct Numerical Simulation of the Flow Around a Golf Ball," Science and Golf V, Proceedings of the World Scientific Congress of Golf, Mesa: Energy in Motion Inc., p. 421.

Quintavalla, S. ((2002), "Golf Ball Performance Evaluation Using High-Volume Indoor Aerodynamic Testing," ITEA Journal, January, pp. 21-25.

Limited R&A Rules (2005), Rule 5-The Golf Ball, in a Guide to the Rules of Clubs and Balls, 2nd Edition, pp. 41-42.

European Search Report issued in EPO Patent Application No. 10172697.4 on Mar. 11, 2011.

PCT/US2012/046904 International Search Report dated Jan. 28, 2013.

Apr. 23, 2015—(JP) Office Action—JP2014-521675.

Apr. 23, 2015—(JP) Office Action—App JP2014-521667.

Apr. 23, 2015—(JP) Office Action—App JP2014-521692.

Machine English Translation of previously submitted JP2002-369896, translation dated Nov. 24, 2014.

Machine English Translation of previously submitted JP2004-147836, translation dated Nov. 24, 2014.

Certified English Translation of JP 2006075210 (published Mar. 23, 2006), translation certified on Feb. 24, 2016.

Certified English Translation of JP 2004147836 (published May 27, 2004), translation certified on Apr. 29, 2015.

Mar. 23, 2016—(JP) Office Action—App 2014521692—Eng Tran.

Ra = Average (1, 4, 6, 8, 5, 2, 1, 4, 1, 2, 1, 4, 7, 4, 1, 2, 5, 8, 5, 2, 1, 4, 1, 1)

Ra = 3.33

GOLF BALL HAVING AN INCREASED MOMENT OF INERTIA

RELATED APPLICATION DATA

This application is a continuation-in-part of U.S. patent application Ser. No. 12/569,955 filed Sep. 30, 2009 in the name of Derek Fitchett and of U.S. patent application Ser. No. 13/184,254 filed Jul. 15, 2011 in the name of Derek Fitchett and Johannes Anderl. These applications are entirely incorporated by reference into the present application as if fully set forth herein.

FIELD OF THE DISCLOSURE

The present disclosure relates to golf balls. Some aspects of this disclosure relate to golf balls having a coating or cover, or both, that increases the ball's moment of inertia to improve its performance. Certain other aspects relate to methods of making such golf balls.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well-known golf superstars, at least in part, have increased golf's popularity in recent years.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rate measurement technology, ball fitting technology, etc.).

Modern golf balls generally comprise either a one-piece construction or multiple layers including an outer cover surrounding a core. Typically, one or more layers of paint and/or other coatings are applied to the outer surface of the golf ball. For example, in one typical design, the outer surface of the golf ball is first painted with at least one clear or pigmented basecoat primer followed by at least one application of a clear coating or topcoat. The clear coating may serve a variety of functions, such as protecting the cover material (e.g., improving abrasion resistance or durability), improving aerodynamics of ball flight, preventing yellowing, and/or improving aesthetics of the ball.

One common coating utilizes a solvent borne two-component polyurethane, which is applied to the exterior of a golf ball. The coating may be applied, for example, by using compressed air or other gas to deliver and spray the coating materials. The balls and spray nozzles may be rotated or otherwise articulated with respect to one another to provide an even coating layer over the entire ball surface.

Dimples were added to golf balls to improve the aerodynamics as compared with smooth balls. Variations of the dimples have been introduced over the years relating to their size, shape, depth, and pattern. Other concepts have included the inclusion of small dimples or other structures within dimples to provide different aerodynamic performance. Such small dimples or other structures, however, often fill up during application of a paint or top coat to the outer surface of the ball, thus destroying or substantially reducing the intended dimple-in-dimple aerodynamic effect of the balls.

While the industry has witnessed dramatic changes and improvements to golf equipment in recent years, some players continue to look for increased distance on their golf shots, particularly on their drives or long iron shots, and/or improved spin or control of their shots, particularly around the greens and/or at initial launch. Accordingly, there is room in the art for further advances in golf technology.

SUMMARY

The following presents a general summary of aspects of the disclosure in order to provide a basic understanding of the disclosure and various aspects of this disclosure. This summary is not intended to limit the scope of the disclosure in any way, but it simply provides a general overview and context for the more detailed description that follows.

Aspects of this disclosure are directed to golf balls having an increased moment of inertia. Such golf balls may include, for example, a core having a first density, a cover encasing the core and including an outer surface, and a coating encasing the cover. The golf balls may include a coating comprising a resin applied to the outer surface of the cover and a plurality of particles comprising a high density material. The coating may have a second density at least twice the first density.

In accordance with some other aspects of the disclosure, a golf ball including a spherical core having a first density, a cover encasing the core and including an outer surface, and a coating encasing the cover is provided, where the coating comprises a resin applied to the outer surface of the cover and a plurality of particles comprising a high density material, and where the coating contributes at least 0.60% of a total moment of inertia of the golf ball.

In some exemplary embodiments of any of the aspects of this disclosure, the high density material comprises a metal. In others, the plurality of particles have an average size of 400 nm to 40 μm. In still others the second density is at least three and a half times the first density. In certain embodiments the cover further includes a second plurality of particles comprising a high density material.

In other exemplary embodiments of this disclosure, the high density material is Tungsten. In yet others the plurality of particles are present in the coating in a sufficient amount so that an exterior surface of the golf ball has a micro surface roughness at least 1.75 times larger than a micro surface roughness of an exterior surface of a comparative ball not including the high density particles but having otherwise identical characteristics. In some embodiments, the core is a solid core. In others, the plurality of particles are contained within the resin.

In still other exemplary embodiments, the golf ball has a mass between 45.2 and 46.0 grams. In certain embodiments, the first density is below 1.050 grams per cubic centimeter and the second density is greater than 2.5 grams per cubic centimeter. In yet others the second density is greater than 3.5 grams per cubic centimeter.

In accordance with some other aspects of the disclosure, a golf ball comprising a spherical core having a first density, a cover encasing the core and including an outer surface and a coating including a resin applied to the outer surface of the cover is provided, where the cover includes a plurality of particles comprising a high density material selected from Tungsten or Gold and where the plurality of particles comprising the high density material provide about 0.10% to about 1.25% of the cover's weight.

In some exemplary embodiments of these aspects of the disclosure, the coating includes a second plurality of particles comprising a high density material. In yet others, the golf ball has a mass between 45.2 and 46.0 grams. In certain others the first density is below 1.050 grams per cubic centimeter.

In accordance with still other aspects of the disclosure, a method of making a golf ball is provided comprising providing a spherical core having a first density, encasing the core with a cover including an outer surface, applying a resin to the outer surface of the cover, and adding a plurality of particles comprising a high density material to the resin in a sufficient amount to form a coating material that has a second density at least two times the first density. In some exemplary embodiments of these aspects of the disclosure, the method further comprises adding a plurality of particles comprising a high density material to the cover. In other exemplary embodiments, the plurality of particles are added to the resin after the resin is applied to the outer surface of the cover. In yet others the plurality of particles are added to the resin before the resin is applied to the outer surface of the cover.

BRIEF DESCRIPTION OF THE DRAWINGS

A more complete understanding of the present disclosure and certain advantages thereof may be acquired by referring to the following detailed description in consideration with the accompanying exemplary drawings, in which.

The reader is advised that the various parts shown in these drawings are not necessarily drawn to scale.

DETAILED DESCRIPTION

In the following description of various example structures, reference is made to the accompanying drawings, which form a part hereof, and in which are shown by way of illustration various example golf ball structures. It is to be understood that other specific arrangements of parts and structures may be utilized and structural and functional modifications may be made without departing from the scope of the present disclosure. As some more specific examples, aspects of this disclosure may be practiced on balls having any desired construction, any number of pieces, any specific dimple design, and/or any desired dimple pattern.

A variety of golf ball constructions have been designed to provide particular playing characteristics. These characteristics generally include control of the initial velocity and spin of the golf ball, which can be optimized for various types of players. For instance, certain players prefer or need a ball that has a high spin rate in order to optimize launch angle and/or control and stop the golf ball around the greens. Other players prefer or require a ball that has a low spin rate and high resiliency to maximize distance and/or prevent excessive lift at initial launch.

The carry distance and/or "feel" of some conventional two-piece solid balls has been improved by altering the typical single layer core and single cover layer construction to provide a multi-layer ball, e.g., a dual cover layer, a dual core layer, and/or a ball having one or more intermediate mantle layers disposed between the cover and the core. Three-piece and four-piece solid balls (and even five-piece balls) are now commonly found and are commercially available. Aspects of this disclosure may be applied to all types of ball constructions, including wound, solid, and/or multi-layer ball constructions.

Figure 1:
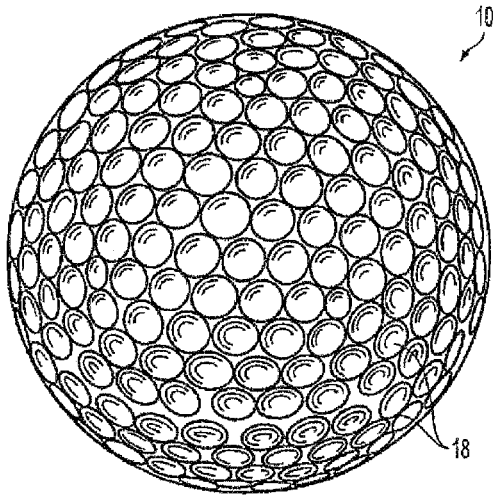
FIG. 1 schematically illustrates a golf ball.
Figure 2:
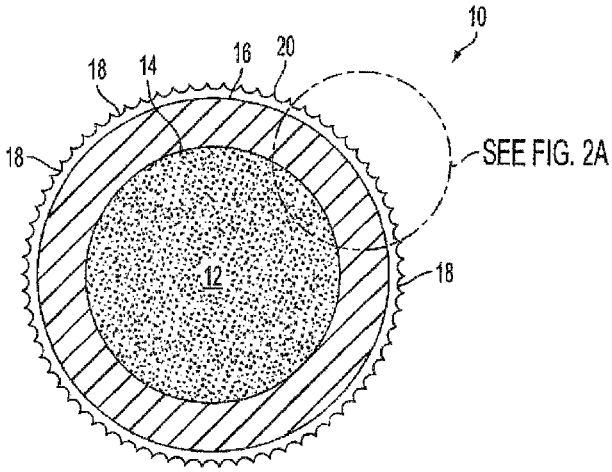
FIGS. 2 and 2A schematically illustrate a cross-sectional view of a golf ball in accordance with FIG. 1 having a coating thereon.
Figure 2A:
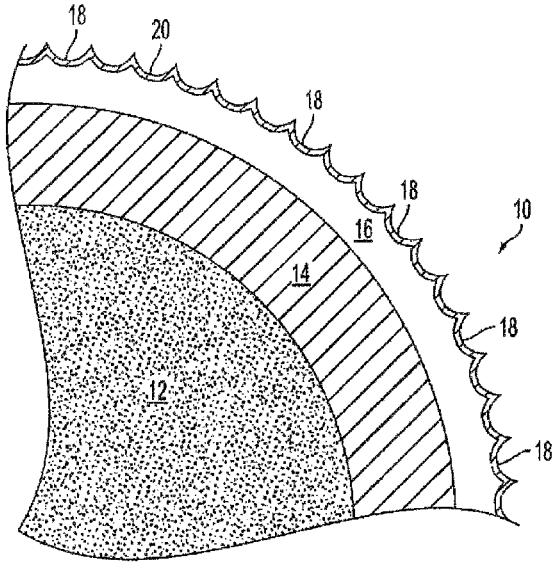

FIG. 1 shows an example of a golf ball 10 that includes a plurality of dimples 18 formed on its outer surface. FIGS. 2 and 2A illustrate one example golf ball 10 in accordance with this disclosure. As shown, this example golf ball has a core 12, an intermediate layer 14, a cover 16 having a plurality of dimples 18 formed therein, and a topcoat 20 applied over the exterior surface of the cover 16 of the ball 10. The golf ball 10 alternatively may be only one piece such that the core 12 represents the entirety of the golf ball 10 structure (optionally with an overlying coating layer 20), and the plurality of dimples 18 are formed on the core 12. The ball 10 also may have any other desired construction (e.g., two-piece solid construction, four-piece solid construction, five-piece solid construction, a wound construction, etc.). The thickness of the topcoat 20 typically is significantly less than that of the cover 16 or the intermediate layer 14, and by way of example may range from about 5 to about 50 μm. The topcoat 20 preferably will have a minimal effect on the depth and volume of the dimples 18. Golf balls 10 according to this disclosure may include one or more pieces for the core 12 (e.g., also called an "inner core," an "outer core," etc.), one or more intermediate layers 14 (e.g., also called "mantle layers" or "barrier layers," etc.), and one or more cover layers 18 (e.g., also called an "inner cover," an "outer cover," etc.).

The golf ball 10 and the various components thereof may be made from any desired materials without departing from this disclosure, including, for example, materials that are conventionally known and used in the golf ball art. As some more specific examples, the cover 16 of the golf ball 10 may be made of any number of materials such as ionomeric, thermoplastic, elastomeric, urethane, TPU, balata (natural or synthetic), polybutadiene materials, or combinations thereof. An optional primer or basecoat may be applied to the exterior surface of the cover 16 of the golf ball 10 prior to application of the coating layer 20. As some more specific examples, the cover layer 16 may be formed of SURLYN® based ionomer resins, thermoplastic polyurethane materials, and thermoset urethane materials, as are conventionally known and used in the art.

As will be described in more detail below, the moment of inertia increasing materials (e.g., the high density materials) may be provided in the cover materials (e.g., at least for an outermost layer or surface of a cover material) in some example structures in accordance with this disclosure. The moment of inertia increasing materials may constitute heavy metal particles, heavy metal alloy particles, and/or other heavy metal containing materials (including polymeric materials) that are dispersed in the material of the cover layer 16 and applied to a golf ball interior structure along with the cover layer 16. The moment of inertia increasing material may be present in the cover layer 16 material in a sufficient amount to increase the cover material's moment of inertia by at least 2.0% (as compared to the same cover material on a ball with the same construction materials and specifications, but without the high density material present). In some examples, the high density materials will be present in the cover layer material in an about of at least 0.10% by weight, and in some examples in an amount of at least 0.5%, at least 0.75%, at least 1.0%, or even at least 1.25% by weight, based on the overall weight of the cover layer material. In some examples, the high density materials will be present in the cover layer material in an amount of at about 0.10%-about 5.0% by weight, and in some examples in an amount of about 0.5%-about 2.0% by weight, and in some examples in an amount of about 0.75%-about 1.25%, by weight, based on the overall weight of the cover layer material.

Additionally or alternatively, the moment of inertia increasing materials (e.g., the high density materials) may be included in a finish material applied to the golf ball over the dimpled cover layer 16. Such finish materials may include, for example, a coating layer 20 over the cover layer 16. A variety of coating materials may be used to form a coating over the golf ball 10, non-limiting examples of which include thermoplastics, thermoplastic elastomers (such as polyurethanes, polyesters, acrylics, low acid thermoplastic ionomers, e.g., containing up to about 15% acid, and UV curable systems), including coating layer materials as are conventionally known or used in the art. The coating layer 20 may constitute a paint layer, a clear coat layer, or other desired material. The thickness of the coating layer 20 will typically range from of about 5 to about 50 μm and in some examples from about 10 to about 15 μm. When present in the coating layer 20, the moment of inertia increasing material may be present in the coating layer material in a sufficient amount to increase the coating layer material's moment of inertia by at least 100% (as compared to the same coating layer as applied to a golf ball surface with the same materials and construction specifications, but without the high density material present). In some examples, the high density materials will be present in the coating layer material in an amount of about at least 2.5% or about at least 5% by weight, and in some examples in an amount of about at least 10%, at least 15%, at least 25% or even at least 40% by weight, based on the overall weight of the coating layer material.

The coating layer 20 may include additional additives, if desired, such as flow additives, mar/slip additives, adhesion promoters, thickeners, gloss reducers, flexibilizers, cross-linking additives, isocyanates or other agents for toughening or creating scratch resistance, optical brighteners, UV absorbers, and the like. The amount of such additives usually ranges from 0 to about 5 wt %, often from 0 to about 1.5 wt %. Such additive materials may be present in coating layer 20 having moment of inertia increasing materials incorporated therein without departing from this disclosure.

With reference again to FIGS. 2 and 2A, a moment of inertia increasing material may be applied to or dispersed across an entire surface of the golf ball 10, such as within the cover 16 or a coating layer 20 applied thereto. For example, Tungsten powder, Gold powder, Tungsten containing materials, and/or Gold containing materials may be combined with a polyurethane composition at a concentration of 0.5 w/w and used to form the cover layer 16. Optionally, a clear topcoat 20 (with or without moment of inertia increasing particles) may be applied over this heavy metal containing cover layer 16.

In other embodiments, a high density, moment of inertia increasing material may be applied to less than an entire surface of the golf ball or other ball, such as in the form of indicia or another pattern. Optionally, the indicia or other pattern may be applied in a symmetrical pattern to the ball so as to provide a more uniform and consistent ball flight. As some more specific examples, the moment of inertia increasing material (e.g., a high density material) may be added to an ink used to print logos, text, stripes, or other shapes or indicia on a ball. Additionally or alternatively, the moment of inertia increasing material may be incorporated into a finish layer of the ball (e.g., applied as a coating layer 20 to a dimpled golf ball cover 16 surface or portion thereof).

The high density material of the moment of inertia increasing system may be provided in any desired manner without departing from this disclosure. By way of example, the amount of increased moment of inertia relative to a similar control ball (i.e., the same ball construction and materials, but without the high density material incorporated in the cover layer and/or the coating layer) may range from about 0.4 to 4.0%, from about 0.7 to 2.3%, from about 1.5 to 2.2%, or from about 1.0 to 2.0%.

Golf balls in accordance with this disclosure may be produced in any desired manner without departing from this disclosure, including in generally conventional manners as are known and used in the art (with the exception of the additional feature of incorporating the moment of inertia increasing materials into the ball construction, as will be explained in more detail below). Some example methods are described in more detail below.

As an initial step in one example golf ball manufacturing process, a golf ball central core is made, e.g., by a molding operation, such as compression molding, hot press molding, injection molding, or other procedures as are known and used in the art. Such cores may be made of rubber materials, elastomeric resin materials (such as highly neutralized acid polymer compositions including HPF resins (e.g., HPF1000, HPF2000, HPF AD1027, HPF AD1035, HPF AD1040 and mixtures thereof, all produced by E. I. DuPont de Nemours and Company), and the like. The cores may have any desired physical properties (e.g., COR, density, sizes, diameters, hardnesses, etc.) and/or additives, including properties and additives that are conventionally known and used in the golf ball art. In some example constructions according to the disclosure, the golf ball cores will be solid materials (optionally an HPF resin material) having a density in the range of 0.900 to 1.100 g/cm$^3$, and optionally in the range of 0.950 to 1.050 g/cm$^3$, 1.000 to 1.050 g/cm$^3$, or even 1.040 to 1.045 g/cm$^3$. Such cores 12 also may have diameters or dimensions in the range of 20 to 41 mm, and in some examples, from 24 to 32 mm, or even from 24 to 28 mm. The core may be any appropriate shape, including but not limited to, a sphere, a cube, a pyramid or any other geometric or oblong shape.

If desired, one or more intermediate layers 14 may be formed over the core 12 in golf ball constructions in accordance with at least some examples of this disclosure. Such intermediate layers 14 may be formed by molding or lamination procedures, such as injection molding. The intermediate layers 14, when present, may be made from any desired material including materials that are conventionally known and used in the art, such as ionomer resins (e.g., SURLYN®'s, as described above), polyurethanes, TPUs, rubbers, and the like. The intermediate layers 14 may have any desired physical properties (e.g., COR, density, thicknesses, hardnesses, etc.) and/or additives, including properties and additives that are conventionally known and used in the art.

The next step in this example golf ball production process involves forming a cover layer 16 around the golf ball interior (e.g., the core 12 and any present intermediate layers 14). The cover material 16 may be an ionomeric resin (e.g., a SURLYN® material), a thermoplastic polyurethane material, a thermosetting polyurethane material, a rubber material, or the like. The core 12, including the center and any present intermediate layers 14, may be supported within a pair of cover mold-halves by a plurality of retractable pins. The retractable pins may be actuated by conventional means known to those of ordinary skill in the art. After the mold halves are closed together with the pins supporting the ball interior, the cover material is injected into the mold in a liquid or flowable state through a plurality of injection ports or gates, such as edge gates or sub-gates. The mold halves will include structures that result in formation of dimples 18 in the cover layer 16. In some example structures in accordance with this disclosure, the cover material may form a base material for carrying the moment of inertia increasing materials (e.g., the high density metal containing materials). The moment of inertia increasing material may be included in all areas of the cover material or in separated and discrete targeted areas of the cover material.

The retractable pins may be retracted after a predetermined amount of cover material has been injected into the mold halves to substantially surround the ball interior. The flowable cover material is allowed to flow and substantially fill the cavity between the ball interior and the mold halves, while maintaining concentricity between the ball interior and the mold halves. The cover material is then allowed to solidify around the ball interior, and the golf balls are ejected from the mold halves. As another option, the golf ball cover 16 may be formed by casting procedures, e.g., as conventionally known and used in this art, although the moment of inertia increasing material may be incorporated into the material used for the casting process, if desired.

Figure 6:
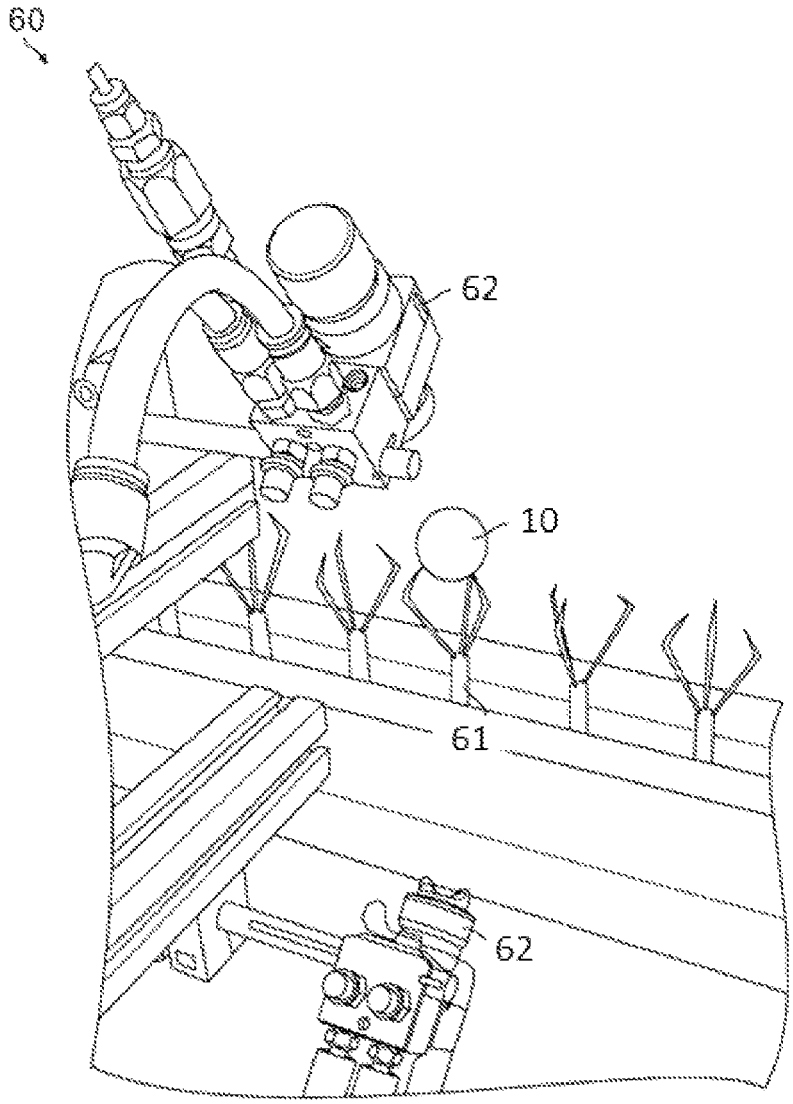
FIG. 6 illustrates a perspective view of a golf ball coating apparatus.

As a next step, if desired, a finish material, such as paint and/or one or more other coating layer(s) 20, may be applied to the golf ball cover 16 surface. In some example structures in accordance with this disclosure, the paint and/or other coating material may form a base material for carrying the moment of inertia increasing material. FIG. 6 illustrates an example apparatus 60 for applying a coating to a golf ball 10. The golf ball 10 is supported on a holder 61 (optionally a rotatable holder). The paint and/or other coating layer 20 may be applied by one or more spray heads 62 (optionally spray heads 62 mounted on articulating arms). Relative motion between the golf ball 10 on holder 61 and the spray heads 62 can help apply the paint and/or other coating layers 20 in a more even, substantially uniformly thick, manner. In some example structures, the paint and/or coating layer 20 may be applied by dipping the golf ball in a bath containing a solution of the paint and/or coating material. The bath may be continuously recirculated to keep the moment of inertia increasing material uniformly distributed within the bath. The golf ball may be dipped in the bath through processes well-understood in the art. The golf ball may be dipped in the bath once and then dried or may be dipped in the bath a series of times with drying stages interspersed between some or all of the dipping stages. The paint and/or other coating material may include other ingredients as well, such as flow additives, mar/slip additives, adhesion promoters, thickeners, gloss reducers, flexibilizers, cross-linking additives, isocyanates or other agents for toughening or creating scratch resistance, optical brighteners, UV absorbers, and the like.

The moment of inertia increasing material may be applied in all areas of the paint and/or coating material or in separated and discrete targeted areas of the paint and/or other coating layer 20 (e.g., by supplying less than all of the available spray heads 62 with high density material-containing coating material). In some examples, if desired, the paint and/or other coating material may be applied in selective areas of the ball 10, e.g., by applying a removable mask to the ball 10 so that certain predetermined areas of the ball 10 are covered when the high density material-containing coating material is applied to the ball 10. When coating is completed, the mask elements may be removed (and optionally additional coating or other finishing may take place).

As another finishing step (which may take place before or after one of the coating steps as described above), printing may be applied to a golf ball. Any desired type of printing technique may be used without departing from this disclosure, including printing techniques such as pad printing and ink jet printing and/or other printing techniques that are conventionally known and used in the art. In some examples in accordance with this disclosure, the printing ink may form a base material for carrying the moment of inertia increasing material (e.g., high density metal containing materials, etc.).

Moment of inertia increasing materials in accordance with this disclosure may be applied to a single part of the ball construction (e.g., one of the cover layer, the coating layer, printing ink, or other finishing material). Alternatively, if desired, moment of inertia increasing materials may be incorporated into more than one of these portions of the ball construction, in any desired combination, without departing from this disclosure. Thus, moment of inertia increasing materials may be incorporated into the cover and coating, but not the ink or paint; into the cover and ink, but not the paint or other coating; into the paint and/or other coating and the ink; into all of the cover, paint, clear coatings, and ink, etc.

In addition to increasing the ball's overall moment of inertia, the moment of inertia increasing materials in accordance with at least some examples of this disclosure may favorably impact other aspects of the aerodynamics of the ball. For example, the moment of inertia increasing materials described above may be incorporated into a cover or coating composition to produce micro surface roughness properties and thereby provide enhanced aerodynamic properties as described in conjunction with such micro surface roughness properties, e.g., in U.S. patent application Ser. No. 12/569,955 (filed Sep. 30, 2009 and entitled "Golf Ball Having an Aerodynamic Coating" in the name of Derek Fitchett) and U.S. patent application Ser. No. 13/184,254 (filed Jul. 15, 2011 and entitled "Golf Ball Having an Aerodynamic Coating Including Micro surface Roughness"), both of which are herein incorporated by reference in their entirety. The moment of inertia increasing materials described above may be incorporated into a cover or coating composition and improve the ball's launch conditions, as evidenced by the effects shown from micro surface roughened golf ball coatings or covers on coefficient of lift and/or drag properties as described in the applications above.

The term "golf ball body" as used herein means a golf ball before applying the top coat (e.g., a ball structure including a core 12, optionally one or more intermediate layers 14, and a (optionally dimpled) cover layer 16, before painting or other coatings or finishing). In terms of the discussion below, the term "coating" often will be used to identify the top coat or last layer applied to the golf ball, but, as also described below, if desired, another coating may be applied over the high density metal-containing coating material or cover layer, if desired. Often the terms "paint" or "painting" may be used synonymously with a "coating" or "coating" process without departing from this disclosure.

Figure 3:
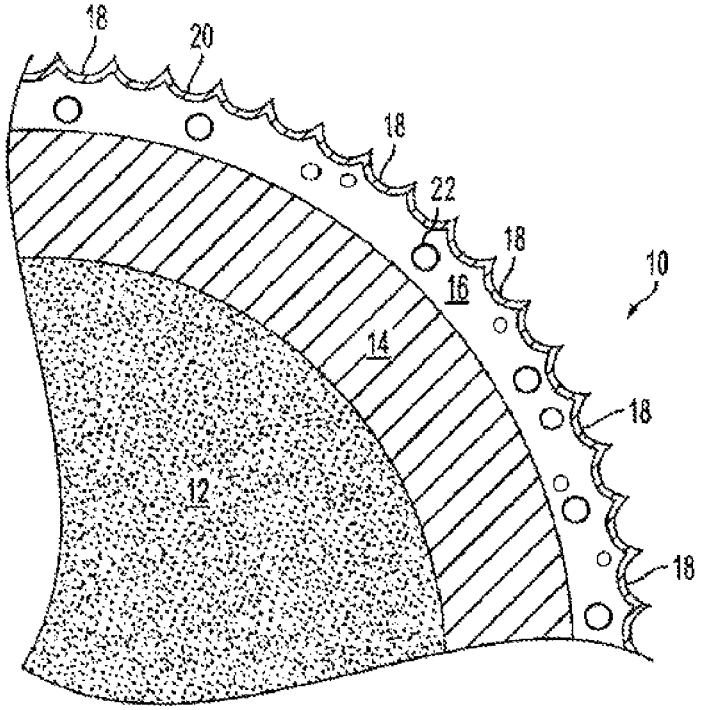
FIG. 3 schematically illustrates a cross-sectional view of a golf ball in accordance with FIGS. 1-2A having a cover containing high density particles enclosing the core.

Some aspects of this disclosure relate to golf balls having a cover layer 16 that comprises high density particles. These high density particles may be mixed into the cover material before it encapsulates the ball interior and solidifies. As described in more detail below, the particles provide a relatively dense cover and result in a golf ball having an increased moment of inertia. The particles may be fully contained within the cover material or may protrude from the cover's exterior surface such that they also provide a golf ball having a roughened surface. As shown in FIG. 3, these high density particles may be interspersed throughout the cover layer 16. The scale of the high density particles 22 is exaggerated in FIG. 3 to help better illustrate features of this aspect of the disclosure. The high density particles incorporated into the cover layer 16 may have a uniform size or may vary in size. In some embodiments, the high density particles in the cover layer 16 may provide micro surface roughness and the coating contains no additional high density particles. In such arrangements and methods, the coating 20 need not be applied so thick as to completely smooth out the areas between particles in cover layer 16 (i.e., so that a desired level of micro surface roughness continues to exist in the final coated product, if such micro surface roughness is desired).

Some other aspects of this disclosure relate to golf balls having a top coat or other coating 20 over the cover layer 16, wherein this coating comprises a resin having high density particles contained therein or applied thereon. As described in more detail below, the high density particles provide a relatively dense coating and result in a golf ball having an increased moment of inertia. The coating 20 with high density particles incorporated therein may also provide a golf ball having a roughened surface, if desired.

Figure 4:
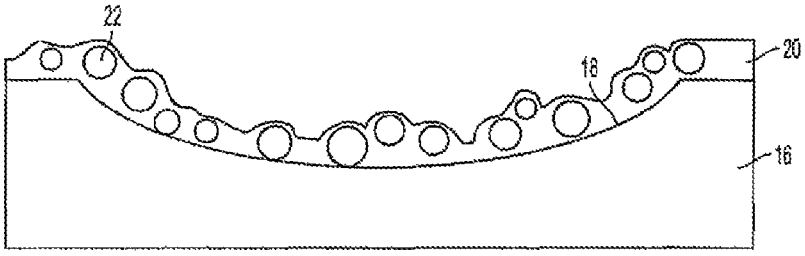
FIG. 4 schematically illustrates a cross-sectional view of a portion of a golf ball having a cover layer and coating in accordance with FIG. 1 having high density particles contained within a resin.

If the resin contains the high density particles, after the resin is applied to the golf ball body to form the coating 20, at least some of the particles may protrude beyond an average thickness of the resin. In some instances, the average size of the particles may be greater than the average thickness of the resin. As shown in FIG. 4, generally the high density particles 22 protrude from the surface such that a thin portion of the resin 20 still covers the particles 22. The surface of the ball will therefore be roughened somewhat, as shown in FIG. 4. The coating 20 thickness and surface roughness shown in FIG. 4 is exaggerated to help better illustrate features of this aspect of the disclosure.

Figure 5:
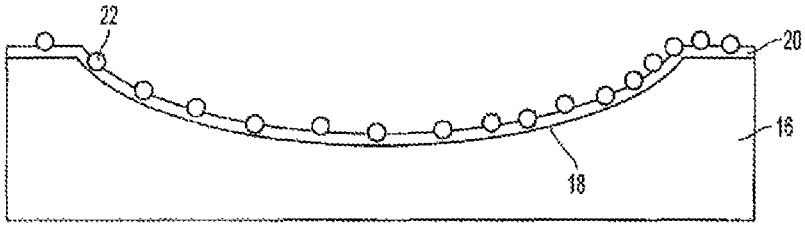
FIG. 5 schematically illustrates a cross-sectional view of a portion of a golf ball having a cover layer and coating in accordance with FIG. 1 having high density particles applied onto the surface of a resin.

If the resin itself does not contain the high density particles necessary to provide the desired moment of inertia properties when it is applied to the golf ball cover 16, after the resin 20 is applied, and prior to drying, high density particles may be applied to the wet resin. The high density particles may adhere to and/or become at least partially embedded into the resin, but may still extend from the surface of the resin to provide a somewhat roughened surface. As shown in FIG. 5, in this example structure and method, particles 22 are applied to the surface of resin 20. Again, the sizes shown in FIG. 5 are exaggerated to help better illustrate features of this aspect of the disclosure.

If desired, the features of FIGS. 3, 4 and 5 may be combined in any combination into a single ball construction. More specifically, if desired, after encasing the core with a cover layer 16 containing high density particles 22 as shown in FIG. 3, a coating process like that shown and described above in conjunction with FIG. 4 may be used to add additional high density particles 22 while providing the coating 20. Additionally or alternatively, if desired, still more high density particles 22 may be adhered to the coating 20 in a process like that shown and described above in conjunction with FIG. 5.

If desired, only one type of coating process, in accordance with the process like that shown and described above in conjunction with either FIG. 4 or 5, may be used to apply the high density particles to the cover layer 16. In such arrangements where the cover layer 16 also includes high density particles 22, the coating 20 should not be applied so thick as to completely smooth out the areas between particles 22 in the cover 16, at least if micro surface roughness is desired in the final product. Additionally, if desired, after coating a cover without high density particles using a process like that shown and described above in conjunction with FIG. 4, additional particles may be adhered to the coating 20 in a process like that shown and described above in conjunction with FIG. 5.

In aspects of the disclosure where some high density particles are added in a process like that shown and described above in conjunction with FIGS. 3, 4, or both, the additional step of post coating particle adherence (e.g., like that of FIG. 5) may be selectively applied to certain areas of the ball (e.g., areas where lower than desired density and/or roughness is observed) or may be applied to specific predetermined areas of the ball (e.g., at the poles, at the seam, at areas covered or "shadowed" by a holding device during an initial coating process, at areas where increased density and/or micro surface roughness is desired, etc.).

The particles 22 allow for a cover layer 16 or coating 20 that is relatively dense in comparison to a cover layer or coating of a comparative ball not including the high density particles but having otherwise identical characteristics (e.g., the same composition, thickness, etc.). These high density particles also may allow fine tuning of and/or improvement to the trajectory of the golf ball by reducing spin off the club as well as to the aerodynamic performance of golf balls in flight, e.g., to enable longer flights of the golf ball, alter lift, less spin decay, etc. The high density particles may increase the ball's moment of inertia to augment the desirable spin characteristics. The particles may also cause the finish of the coating to be rougher and on a micro-scale act as small dimples, which is believed to increase the turbulence in the air flow around the ball and shift flow separation to the back of the golf ball, thereby reducing pressure drag. Also, if desired, the durability of the golf ball may be improved both in cut resistance and abrasion resistance, e.g., depending on the properties of and/or materials used in the coating 20.

Given the general description of various example aspects of the disclosure provided above, more detailed descriptions of various specific examples of golf ball structures according to the disclosure are provided below.

The following discussion and accompanying figures describe various example golf balls in accordance with aspects of the present disclosure. When the same reference number appears in more than one drawing, that reference number is used consistently in this specification and the drawings to refer to the same or similar parts throughout.

Aspects of the disclosure relate to golf balls with an increased moment of inertia ("MOI") as compared to a control ball with the same materials, construction, and construction specification but without the moment of inertia increasing material incorporated into it. MOI is a measure of the resistance to angular acceleration, i.e. twisting or rotating about an axis. Thus, objects with a higher MOI require more force to alter the object's rotational velocity, i.e. the object's spin or lack thereof. The MOI of an object can be calculated when various properties of the object are known. For solid spherical objects, the MOI may be calculated by the following equation:

$$\frac{2}{5}R^2 \cdot \rho \cdot \frac{4}{3}\pi R^3,$$

where ρ is the density of the sphere and R is the length of its outer radius. When a sphere is not a one-piece solid, such as, for example, the cover layer of a golf ball, the MOI for the layer can be determined using two calculations, one using the smaller length of the inner radius and one using the larger length of the outer radius. When the MOI based on the smaller length of the inner radius is subtracted from the MOI based on the larger length of the outer radius, the difference provides the MOI for the hollow sphere or spherical shell. By doing this for all layers of a golf ball, the MOI for each layer or component of the ball may be calculated, where the sum of these MOI's provides the overall MOI for the golf ball as a whole. As the overall MOI is dependent on both radial distance and the density of the various ball components, having denser materials near the outside of the ball can increase the overall ball MOI. While this increases the mass of the ball, if this difference is offset by using lighter or less dense materials in the interior components of the ball, the MOI can be increased while still keeping the ball within a predetermined weight range, e.g., in compliance with the requirements of the USGA rules, which dictate the weight of the golf ball, and under which, at present a golf ball must weigh no more than 1.62 oz (45.93 grams). Among other aspects of the disclosure, this is achieved while preserving the other desirable characteristics of the golf ball. Accordingly, golf ball products in accordance with this disclosure may have a weight within the range of 45 to 46 grams, and in some examples, within the range of 45.2 to 46 grams or even within the range of 45.4 to 46 grams.

The high density particles may be of any shape and may be regular, irregular, uniform, non-uniform, or mixtures thereof. The particles may be any polygon or other geometric shape, including regular shapes, such as spheres or cubes. The spheres may have a round cross-section or may be flattened to provide an elongated or oval cross-section. The cubes may be of square or rectangular cross-section. Irregular shapes may be defined by an irregular surface, an irregular perimeter, protrusions, or extensions. The particles may be rounded, elongated, smooth, rough, or have edges. Combinations of different shapes of particles may be used. Crystalline or regular particles, such as tetrapods, may also be used.

The high density particles may comprise any material known in the art having a sufficient density. In some exemplary embodiments, the high density particles comprise a material having a density greater than around 7.0 grams per cubic centimeter. In other embodiments the high density particles comprise a material having a density between around 7.0 grams per cubic centimeter and around 20.0 grams per cubic centimeter, in still others from a material having a density between around 11.0 grams per cubic centimeter and around 20.0 grams per cubic centimeter, in others from a material having a density between around 12.0 grams per cubic centimeter and around 20.0 grams per cubic centimeter, and it yet others a material having a density between around 19.0 grams per cubic centimeter and around 23.0 grams per cubic centimeter. In still other embodiments, the high density particles comprise a mixture of two or more materials having different densities, or two or more different materials are used in the cover and coating.

The high density particles may be made of or comprise any appropriate material known in the art such as metals, alloys, organic or inorganic, plastics, composite materials, and ceramics. Suitable metals for different embodiments can include, but are not limited to, any transition metal including Tungsten, Iridium, Osmium, Platinum, Gold, Neptunium, Tantalum, Rhodium, Molybdenum, Silver, Copper, Nickel, Iron, Manganese, Cadmium, or alloys including one or more of these metals. Other suitable metals include, but are not limited to, Tin, Lead, or any alloys, optionally alloys with any transition or non-transition metal. In some embodiments of the disclosure, multiple types of high density particles may be used in the cover, coating, or both. In certain of these embodiments, at least one type of particles is present in the cover while at least one other type of particles is present in the coating.

The particles may be selected to provide a desired level of overall density in the cover layer and/or coating. The density may be relatively high when compared to the density of the core. In some embodiments, the density of the coating is at least twice that of the core. In others it is at least three times the density of the core. In yet others it will be at least three and a half times the density of the core. In still others the density of the coating will be at least four times the density of the core, and in certain other embodiments it will be at least five times the density of the core. In yet other embodiments it will be at least six times the density of the core. In some exemplary embodiments, the core will have a density below 1.050 grams per cubic centimeter and the coating will have a density greater than 2.5 grams per cubic centimeter, greater than 3.5 grams per cubic centimeter, or even greater than 5.0 grams per cubic centimeter.

In some embodiments, the contribution of the high density particle containing coating to the golf ball's overall MOI will be at least 0.6% of the golf ball's overall MOI. In certain other embodiments the MOI contribution of the coating will be at least 0.7%, in yet others at least 0.8%, and in still others at least 0.9% or at least 1.0% based on the overall MOI of the ball. In some exemplary embodiments, the MOI contribution from the high density material containing coating will be at least 1.25%, at least 1.5%, at least 1.75%, at least 2.0% or at least 2.5%.

The high density particles may be of any suitable hardness and durability. Softer particles tend to affect spin, for example. The average size of the particles may depend on various factors, such as the material selected for the particles. Generally, the particle sizes will range from 400 nm to 40 microns, and in some example constructions, from 5 to 20 microns. In one particular example, the particle sizes range from 8 to 12 microns. The particles may be approximately the same size or may be different sizes, optionally within the defined ranges. If the particles are applied to the surface of the resin (e.g., as in FIG. 5), they may be smaller than if they were contained within the coating (e.g., as in FIG. 4).

When the cover includes more than one layer, e.g., an inner cover layer and an outer cover layer, various constructions and materials are suitable. For example, an inner cover layer may surround the intermediate layer with an outer cover layer disposed thereon or an inner cover layer may surround one or a plurality of intermediate layers. When multiple cover layers are used, none, one, both, or all may include the high density particles.

In addition, high density particles may be incorporated into the cover to increase its density relative to a cover of a comparative ball not including the particles but having otherwise identical characteristics and composition. In some exemplary embodiments, the high density particles in the cover comprise Tungsten or Gold. The cover may have, as a base material, any of the various materials described above. The amount of the high density particles may range from about 0.1% of the cover weight to about 2.0 wt %. In some embodiments, the amount of the high density particles in the cover is at least 0.1 wt % of the cover, at least 0.25%, at least 0.5%, or at least 0.75 wt %. In still other embodiments, the amount of the high density particles in the cover is at least 1.0 wt %, or even 1.25%.

According to one aspect of the disclosure, a cover is formed around the golf ball core by encasing the core and allowing the cover to solidify around it. The high density particles may be added to cover material while it is in a liquid or flowable state and mixed until sufficiently dispersed therein. Any of the suitable materials described above may constitute the high density particles.

As noted above, for the coating, any suitable resin may be used including thermoplastics, thermoplastic elastomers such as polyurethanes, polyesters, acrylics, low acid thermoplastic ionomers, e.g., containing up to about 15% acid, and UV curable systems. Specific examples include AKZO NOBEL 7000A 103. Paints and topcoats of the types conventionally known and used in golf ball production (e.g., as coating layer 20) may be used as the base resin to contain moment of inertia increasing particles.

The viscosity of the resin prior to application to the golf ball body may be about generally 16 to 24 seconds as measured by #2 Zahn cup. Generally the resin is thin enough to easily spray the coating onto the golf ball body, but thick enough to prevent the resin from substantially running after application to the golf ball body.

The thickness of the applied resin (after drying) typically ranges from of about 8 to about 50 μm ("microns"), and in some examples, from about 10 to about 15 μm. In certain other embodiments, it ranges from about 10 to about 20 μm, while in still others it ranges from about 10 to about 30 μm. In others it may range from about 20 to about 30 μm, while in certain others it may range from about 20 to about 50 μm. In some embodiments of the disclosure, higher coating thicknesses are used to additionally boost the golf ball's MOI. When the high density particles are contained within the resin, the thickness of the resin may be less than the particle size in order to allow at least some of the particles to protrude from the resin, if micro surface roughness features are desired.

The coating may contain a plurality of high density particles, generally, from around 0% to around 80 wt % particles based on total coating weight, and in some examples at least about 2.5%, at least about 5%, at least about 10%, at least about 15%, at least about 20%, at least about 25%, at least about 30%, or at least around 40%. In some embodiments, the high density particles include Tungsten, Gold, Lead or similar density metals.

The coating may be clear or opaque and may be white or have a tint or hue or other coloring pigment. The particles may be of any color. Application of the coating including particles to the outside of the golf ball, if present in a sufficient amount, may give the ball somewhat of a dull or matte finish, as compared to the brighter or shinier finish of many conventional golf balls. The particles tend to diffuse some of the light in a clear coat, for example.

According to one aspect of the present disclosure, a coating is formed by applying and drying a resin on the surface of the golf ball body. The method of applying the resin is not limited. For example, a two-component curing type resin such as a polyurethane may be applied by an electrostatic coating method, or by a spray method using a spray gun, for example, after mixing an aqueous polyol liquid with a polyisocyanate. In the case of applying the coating with the spray gun, the aqueous polyol liquid and the polyisocyanate may be mixed bit by bit, or the aqueous polyol liquid and the polyisocyanate are fed with the respective pumps and continuously mixed in a constant ratio through the static mixer located in the stream line just before the spray gun. Alternatively, the aqueous polyol liquid and the polyisocyanate can be air-sprayed respectively with the spray gun having the device for controlling the mixing ratio thereof. Subsequently, the two-component curing type urethane resin on the surface of the golf ball body is dried.

In one aspect, the coating comprises resin (with any additives) and high density particles mixed therein. The coating is applied to the golf ball body such as described above. Prior to application to the golf ball body, the high density particles may be added to the resin as a separate ingredient, or may be pre-mixed with one of the components in a two-component coating composition.

In another aspect, a resin layer (with any additives) is applied to the golf ball body such as described above. Prior to drying, high density particles are applied to the top of the wet resin layer using a media blaster, sand blaster, powder coating device, or other suitable device. The particles may adhere to the surface and/or be embedded into the surface of the resin layer.

In another aspect, a very thin resin layer may be applied on top of the high density particles to hold the particles in place. This resin layer may be composed of the same or a different resin layer initially applied, but it may have a thinner viscosity. This additional thin layer of resin may be provided, if necessary or desired, to fine tune or somewhat reduce the exterior surface roughness of the ball.

Examples

Exemplary four piece golf ball embodiments of the disclosure may include the following coatings and then may be tested for various properties:

Control—Standard Rubber Core, Polyurethane Clear Coat with no added Tungsten Particles, coat thickness of 15 microns.

Inventive #1—Lightweight Resin Core, Polyurethane Clear Coat with 15% by weight Tungsten particles, coat thickness of 15 microns.

Inventive #2—Lightweight Resin Core, Polyurethane Clear Coat with 20% by weight Tungsten particles, coat thickness of 15 microns.

In TABLE 1 below, all density values are in grams per cubic centimeter (g/cm$^3$) and all MOI values are in grams×squared centimeter (g-cm$^2$).

TABLE 1

| | Golf Ball Component | Metal Content (% weight) | Density | Outer Radius (cm) | Inner Radius (cm) | Outer Radius MOI | Inner Radius MOI | Component MOI | Overall MOI | Relative Overall MOI Increase | Component MOI Contribution | Total Mass (g) |
|---|---|---|---|---|---|---|---|---|---|---|---|---|
| Control Ball | Core | — | 1.070 | 1.225 | 0 | 4.946 | 0 | 4.946 | 83.917 | — | 5.9% | 45.512 |
| | Outer Core | — | 1.110 | 1.930 | 1.225 | 49.803 | 5.130 | 44.673 | | | 53.2% | |
| | Mantle | — | 1.160 | 2.025 | 1.930 | 66.181 | 52.047 | 14.134 | | | 16.8% | |
| | Cover | — | 1.150 | 2.135 | 2.025 | 85.474 | 65.610 | 19.864 | | | 23.7% | |
| | Coating | — | 1.150 | 2.137 | 2.135 | 85.775 | 85.474 | 0.301 | | | 0.4% | |
| Inventive #1 | Core | — | 1.040 | 1.225 | 0 | 4.807 | 0 | 4.807 | 84.492 | 0.69% | 5.7% | 45.516 |
| | Outer Core | — | 1.110 | 1.930 | 1.225 | 49.803 | 5.130 | 44.673 | | | 52.9% | |
| | Mantle | — | 1.160 | 2.025 | 1.930 | 66.181 | 52.047 | 14.134 | | | 16.7% | |
| | Cover | — | 1.150 | 2.135 | 2.025 | 85.474 | 65.610 | 19.864 | | | 23.5% | |
| | Coating | 15% Tungsten | 3.880 | 2.1365 | 2.135 | 289.398 | 288.383 | 1.014 | | | 1.2% | |
| Inventive #2 | Core | — | 1.044 | 1.225 | 0 | 4.825 | 0 | 4.825 | 84.749 | 0.99% | 5.7% | 45.625 |
| | Outer Core | — | 1.110 | 1.930 | 1.225 | 49.803 | 5.130 | 44.673 | | | 52.7% | |
| | Mantle | — | 1.160 | 2.025 | 1.930 | 66.181 | 52.047 | 14.134 | | | 16.7% | |
| | Cover | — | 1.150 | 2.135 | 2.025 | 85.474 | 65.610 | 19.864 | | | 23.4% | |
| | Coating | 20% Tungsten | 4.790 | 2.1365 | 2.135 | 357.272 | 356.019 | 1.252 | | | 1.5% | |

As shown in the data for the first two exemplary four-piece solid golf ball embodiments, by shifting to core materials with a lower density, the moment of inertia of the golf ball as a whole can be increased by utilizing denser materials in the coating. Outside of the differences in density/material of the core and the density of the coating, the specifications of these golf balls are identical (density of other components, coating thickness, etc.). By incorporating high density particles in the coating, however, the MOI contribution of the coating is much larger in the inventive golf balls and this allows the inventive golf balls as a whole to have a larger MOI than the control ball. In these examples, this is done with virtually no changes to the overall mass (as shown by Inventive #1) or with minor changes to the overall mass (as shown by Inventive #2), but with the mass still falling within USGA rules. These masses are merely exemplary and the golf balls of the disclosure may have any mass suitable for use and desired performance. In other examples of the disclosure, the mass may more closely approach the USGA's maximum golf ball weight of 45.93 grams to, amongst other benefits, obtain an even larger MOI benefit. In certain of these examples, a lower density core may not be necessary depending on the other characteristics of the ball, as long as high density particles may be added to increase MOI while staying within the specifications of the USGA or other desired weight parameters. Moreover, given the benefit of this disclosure a skilled artisan would understand that the amount of high density particles can range greatly to preserve other desirable properties such as "feel" of the ball while still imparting some benefit to MOI, and the disclosure is not limited solely to golf balls where MOI is maximized at any cost.

Table 2 provides information related to other exemplary embodiments of the disclosure. These embodiments are merely illustrative and are meant to help demonstrate various aspects of the scope of the disclosure. All of these exemplary embodiments have a mass of 45.925-45.93 grams, but as noted above it is not a requirement of the disclosure to have this high of a mass. Moreover, the high density particles do not need to be present in these high of amounts to obtain a MOI benefit.

The values for the Control Ball from Table 1 are used for comparative purposes but are not explicitly recited again in Table 2:

TABLE 2

| | Golf Ball Component | Metal Content (% weight) | Density | Outer Radius (cm) | Overall MOI | Relative Overall MOI Increase | Component MOI Contribution |
|---|---|---|---|---|---|---|---|
| Exemplary Two Piece Golf Balls | | | | | | | |
| Inventive #3 | Core | — | 1.150 | 2.025 | 84.293 | 0.45% | 75.5% |
| | Cover | — | 1.150 | 2.135 | | | 23.6% |
| | Coating (10 microns) | 19.39% Tungsten | 4.680 | 2.136 | | | 1.0% |
| Inventive #4 | Core | — | 1.150 | 2.025 | 84.25 | 0.45% | 75.5% |
| | Cover | — | 1.150 | 2.135 | | | 23.6% |
| | Coating (15 microns) | 10.85% Tungsten | 3.125 | 2.1365 | | | 1.0% |
| Inventive #5 | Core | — | 1.150 | 2.025 | 84.262 | 0.41% | 75.5% |
| | Cover | 0.18% Tungsten | 1.183 | 2.135 | | | 24.1% |
| | Coating (10 microns) | — | 1.150 | 2.136 | | | 0.4% |
| Inventive #6 | Core | — | 1.150 | 2.025 | 84.248 | 0.39% | 75.5% |
| | Cover | 0.15% Tungsten | 1.183 | 2.135 | | | 24.3% |
| | Coating (15 microns) | — | 3.125 | 2.1365 | | | 0.2% |

TABLE 2-continued

| | Golf Ball Component | Metal Content (% weight) | Density | Outer Radius (cm) | Overall MOI | Relative Overall MOI Increase | Component MOI Contribution |
|---|---|---|---|---|---|---|---|
| | | Exemplary Three Piece Golf Balls | | | | | |
| Inventive #7 | Core | — | 1.051 | 1.225 | 84.898 | 1.17% | 5.7% |
| | Outer Core | — | 1.135 | 2.025 | | | 70.1% |
| | Cover | — | 1.150 | 2.135 | | | 23.4% |
| | Coating (10 microns) | 14.72% Tungsten | 3.830 | 2.136 | | | 0.8% |
| Inventive #8 | Core | — | 1.040 | 1.225 | 85.854 | 2.31% | 5.6% |
| | Outer Core | — | 1.110 | 2.025 | | | 67.8% |
| | Cover | — | 1.150 | 2.135 | | | 23.1% |
| | Coating (15 microns) | 56.41% Tungsten | 11.416 | 2.1365 | | | 3.5% |
| Inventive #9 | Core | — | 1.040 | 1.225 | 85.709 | 2.13% | 5.6%% |
| | Outer Core | — | 1.110 | 2.025 | | | 67.9% |
| | Cover | 0.81% Tungsten | 1.297 | 2.135 | | | 26.1% |
| | Coating (15 microns) | — | 1.150 | 2.1365 | | | 0.4% |
| Inventive #10 | Core | — | 1.051 | 1.225 | 84.876 | 1.14% | 5.7% |
| | Outer Core | — | 1.135 | 2.025 | | | 70.1% |
| | Cover | 0.15% Tungsten | 1.170 | 2.135 | | | 23.8% |
| | Coating (15 microns) | — | 1.150 | 2.1365 | | | 0.4% |
| | | Exemplary Four Piece Golf Balls | | | | | |
| Inventive #11 | Core | — | 1.040 | 1.225 | 85.752 | 2.19% | 5.6% |
| | Outer Core | — | 1.110 | 1.930 | | | 52.1% |
| | Mantle | — | 1.160 | 2.025 | | | 16.5% |
| | Cover | — | 1.150 | 2.135 | | | 23.2% |
| | Coating (10 microns) | 65.38% Tungsten | 13.050 | 2.136 | | | 2.7% |
| Inventive #12 | Core | — | 1.040 | 1.225 | 85.753 | 2.19% | 5.6% |
| | Outer Core | — | 1.110 | 1.930 | | | 52.1% |
| | Mantle | — | 1.160 | 2.025 | | | 16.5% |
| | Cover | — | 1.150 | 2.135 | | | 23.2% |
| | Coating (15 microns) | 41.48% Tungsten | 8.700 | 2.1365 | | | 2.7% |
| Inventive #13 | Core | — | 1.040 | 1.225 | 85.752 | 2.19% | 5.6% |
| | Outer Core | — | 1.110 | 1.930 | | | 52.1% |
| | Mantle | — | 1.160 | 2.025 | | | 16.5% |
| | Cover | — | 1.150 | 2.135 | | | 23.2% |
| | Coating (20 microns) | 29.51% Tungsten | 6.520 | 2.137 | | | 2.7% |
| Inventive #14 | Core | — | 1.051 | 1.225 | 85.543 | 1.94% | 5.7% |
| | Outer Core | — | 1.110 | 1.930 | | | 52.2% |
| | Mantle | — | 1.160 | 2.025 | | | 16.5% |
| | Cover | — | 1.150 | 2.135 | | | 23.2% |
| | Coating (10 microns) | 51.20% Tungsten | 11.560 | 2.136 | | | 2.4% |
| Inventive #15 | Core | — | 1.051 | 1.225 | 85.545 | 1.94% | 5.7% |
| | Outer Core | — | 1.110 | 1.930 | | | 52.2% |
| | Mantle | — | 1.160 | 2.025 | | | 16.5% |
| | Cover | — | 1.150 | 2.135 | | | 23.2% |
| | Coating (20 microns) | 25.44% Tungsten | 5.780 | 2.137 | | | 2.4% |
| Inventive #16 | Core | — | 1.040 | 1.225 | 85.644 | 2.06% | 5.6% |
| | Outer Core | — | 1.110 | 1.930 | | | 52.2% |
| | Mantle | — | 1.160 | 2.025 | | | 16.5% |
| | Cover | 0.59% Tungsten | 1.258 | 2.135 | | | 25.4% |
| | Coating (15 microns) | — | 1.150 | 2.1365 | | | 0.4% |
| Inventive #17 | Core | — | 1.040 | 1.225 | 85.669 | 2.09% | 5.6% |
| | Outer Core | — | 1.110 | 1.930 | | | 52.1% |
| | Mantle | — | 1.160 | 2.025 | | | 16.5% |
| | Cover | 0.50% Tungsten | 1.241 | 2.135 | | | 25.0% |
| | Coating (15 microns) | 6.70% Tungsten | 2.370 | 2.1365 | | | 0.7% |

TABLE 2-continued

| | Golf Ball Component | Metal Content (% weight) | Density | Outer Radius (cm) | Overall MOI | Relative Overall MOI Increase | Component MOI Contribution |
|---|---|---|---|---|---|---|---|
| Inventive #18 | Core | — | 1.040 | 1.225 | 85.710 | 2.14% | 5.6% |
| | Outer Core | — | 1.110 | 1.930 | | | 52.1% |
| | Mantle | — | 1.160 | 2.025 | | | 16.5% |
| | Cover | 0.25% Tungsten | 1.196 | 2.135 | | | 24.1% |
| | Coating (15 microns) | 24.07% Tungsten | 5.530 | 2.137 | | | 1.7% |
| Inventive #19 | Core | — | 1.040 | 1.225 | 85.689 | 2.11% | 5.6% |
| | Outer Core | — | 1.110 | 1.930 | | | 52.1% |
| | Mantle | — | 1.160 | 2.025 | | | 16.5% |
| | Cover | 0.38% Tungsten | 1.219 | 2.135 | | | 24.6% |
| | Coating (15 microns) | 15.00% Tungsten | 3.880 | 2.1365 | | | 1.2% |
| Inventive #20 | Core | — | 1.040 | 1.225 | 85.695 | 2.12% | 5.6% |
| | Outer Core | — | 1.110 | 1.930 | | | 52.1% |
| | Mantle | — | 1.160 | 2.025 | | | 16.5% |
| | Cover | 0.34% Tungsten | 1.212 | 2.135 | | | 24.4% |
| | Coating (20 microns) | 11.87% Tungsten | 3.310 | 2.137 | | | 1.3% |
| Inventive #21 | Core | — | 1.040 | 1.225 | 85.696 | 2.12% | 5.6% |
| | Outer Core | — | 1.110 | 1.930 | | | 52.1% |
| | Mantle | — | 1.160 | 2.025 | | | 16.5% |
| | Cover | 0.34% Tungsten | 1.212 | 2.135 | | | 24.4% |
| | Coating (25 microns) | 8.24% Tungsten | 2.650 | 2.138 | | | 1.3% |
| Inventive #22 | Core | — | 1.040 | 1.225 | 85.753 | 2.19% | 5.6% |
| | Outer Core | — | 1.110 | 1.930 | | | 52.1% |
| | Mantle | — | 1.160 | 2.025 | | | 16.5% |
| | Cover | — | 1.115 | 2.135 | | | 23.2% |
| | Coating (25 microns) | 22.33% Tungsten | 5.215 | 2.1375 | | | 2.7% |
| Inventive #23 | Core | — | 1.040 | 1.225 | 85.756 | 2.19% | 5.6% |
| | Outer Core | — | 1.110 | 1.930 | | | 52.1% |
| | Mantle | — | 1.160 | 2.025 | | | 16.5% |
| | Cover | — | 1.115 | 2.135 | | | 23.2% |
| | Coating (50 microns) | 7.99% Tungsten | 2.605 | 2.140 | | | 2.7% |
| Inventive #24 | Core | — | 0.960 | 1.225 | 87.172 | 3.88% | 5.1% |
| | Outer Core | — | 1.110 | 1.930 | | | 51.2% |
| | Mantle | — | 1.160 | 2.025 | | | 16.2% |
| | Cover | 0.5% Tungsten | 1.241 | 2.135 | | | 24.6% |
| | Coating (15 microns) | 46.06% Tungsten | 9.530 | 2.1365 | | | 2.9% |
| Inventive #25 | Core | — | 0.960 | 1.225 | 87.172 | 3.88% | 5.1% |
| | Outer Core | — | 1.110 | 1.930 | | | 51.2% |
| | Mantle | — | 1.160 | 2.025 | | | 16.2% |
| | Cover | 0.5% Tungsten | 1.241 | 2.135 | | | 24.6% |
| | Coating (20 microns) | 32.84% Tungsten | 7.145 | 2.137 | | | 2.9% |
| Inventive #26 | Core | — | 0.960 | 1.225 | 87.173 | 3.88% | 5.1% |
| | Outer Core | — | 1.110 | 1.930 | | | 51.2% |
| | Mantle | — | 1.160 | 2.025 | | | 16.2% |
| | Cover | 0.5% Tungsten | 1.241 | 2.135 | | | 24.6% |
| | Coating (25 microns) | 25.08% Tungsten | 5.715 | 2.1375 | | | 2.9% |
| Inventive #27 | Core | — | 0.960 | 1.225 | 87.222 | 3.94% | 5.1% |
| | Outer Core | — | 1.110 | 1.930 | | | 51.2% |
| | Mantle | — | 1.160 | 2.025 | | | 16.2% |
| | Cover | 0.23% Tungsten | 1.191 | 2.135 | | | 23.6% |
| | Coating (50 microns) | 15.08% Tungsten | 3.895 | 2.140 | | | 3.9% |
| Inventive #28 | Core | — | 0.960 | 1.225 | 87.088 | 3.78% | 5.1% |
| | Outer Core | — | 1.110 | 1.930 | | | 51.3% |
| | Mantle | — | 1.160 | 2.025 | | | 16.2% |
| | Cover | 1.0% Tungsten | 1.332 | 2.135 | | | 26.4% |
| | Coating (10 microns) | 20.05% Tungsten | 4.800 | 2.136 | | | 1.0% |

TABLE 2-continued

| | Golf Ball Component | Metal Content (% weight) | Density | Outer Radius (cm) | Overall MOI | Relative Overall MOI Increase | Component MOI Contribution |
|---|---|---|---|---|---|---|---|
| Inventive #29 | Core | — | 0.960 | 1.225 | 87.172 | 3.88% | 5.1% |
| | Outer Core | — | 1.110 | 1.930 | | | 51.2% |
| | Mantle | — | 1.160 | 2.025 | | | 16.2% |
| | Cover | 0.5% Tungsten | 1.241 | 2.135 | | | 24.6% |
| | Coating (10 microns) | 72.25% Tungsten | 14.300 | 2.140 | | | 2.9% |
| Inventive #30 | Core | — | 1.040 | 1.225 | 85.576 | 2.19% | 5.6% |
| | Outer Core | — | 1.110 | 1.930 | | | 52.1% |
| | Mantle | — | 1.160 | 2.025 | | | 16.5% |
| | Cover | — | 1.241 | 2.135 | | | 23.2% |
| | Coating (50 microns) | 14.26% Lead | 2.605 | 2.140 | | | 2.7% |
| Inventive #31 | Core | — | 0.960 | 1.225 | 87.085 | 3.77% | 5.1% |
| | Outer Core | — | 1.110 | 1.930 | | | 51.3% |
| | Mantle | — | 1.160 | 2.025 | | | 16.2% |
| | Cover | 0.95% Tungsten | 1.322 | 2.135 | | | 26.2% |
| | Coating (50 microns) | — | 1.150 | 2.140 | | | 1.2% |
| Inventive #32 | Core | — | 0.960 | 1.225 | 87.057 | 3.74% | 5.1% |
| | Outer Core | — | 1.110 | 1.930 | | | 51.3% |
| | Mantle | — | 1.160 | 2.025 | | | 16.2% |
| | Cover | 1.19% Tungsten | 1.367 | 2.135 | | | 27.1% |
| | Coating (10 microns) | — | 1.150 | 2.136 | | | 0.2% |
| Inventive #33 | Core | — | 0.960 | 1.225 | 85.744 | 2.18% | 5.6% |
| | Outer Core | — | 1.110 | 1.930 | | | 52.1% |
| | Mantle | — | 1.160 | 2.025 | | | 16.5% |
| | Cover | 0.10% Tungsten | 1.156 | 2.135 | | | 23.3% |
| | Coating (20 microns) | 27.74% Tungsten | 6.200 | 2.137 | | | 2.5% |
| Inventive #34 | Core | — | 0.960 | 1.225 | 85.756 | 2.19% | 5.6% |
| | Outer Core | — | 1.110 | 1.930 | | | 52.1% |
| | Mantle | — | 1.160 | 2.025 | | | 16.5% |
| | Cover | — | 1.150 | 2.135 | | | 23.2% |
| | Coating (50 microns) | 14.26% Iron | 2.605 | 2.140 | | | 2.7% |
| Inventive #35 | Core | — | 1.040 | 1.225 | 85.669 | 2.09% | 5.6% |
| | Outer Core | — | 1.110 | 1.930 | | | 52.1% |
| | Mantle | — | 1.160 | 2.025 | | | 16.5% |
| | Cover | 0.5% Tungsten | 1.241 | 2.135 | | | 25.0% |
| | Coating (15 microns) | 11.96% Lead | 2.370 | 2.1375 | | | 0.7% |

In addition to the MOI effects of the high density particles, as discussed in the parent application U.S. patent application Ser. No. 13/184,254, the particles may also provide micro surface roughness properties. Golf balls in accordance with examples of this disclosure were subjected to various aerodynamic tests as described in more detail in that application, which is incorporated by reference in its entirety.

To evaluate these aspects of the disclosure, the "surface roughness" (also called "Ra" in this specification) of various balls was evaluated. Surface roughness may be thought of as the arithmetic average of deviation from an ideal surface, and it may be calculated according to the following formula:

$$R_a = 1/n\sum_{i=1}^{n}|y_i|$$

where y represents the height of the surface's deviation from an "ideal surface" at a specific location and "n" represents the number of height deviation measurements made on the surface. The ideal surface may be defined as the location of the perfectly smooth surface without roughness or height deviations, e.g., the average surface location over the area measured. In at least some instances, the ideal surface may be defined by a "best fit" curve derived from a three-dimensional surface scan of the ball's surface (described in more detail below) and/or derived at least in part from CAD data representing the surface of the mold cavity from which the ball cover is formed (optionally taking into account the additional thickness provided by any post-mold coating(s)).

Figure 7:
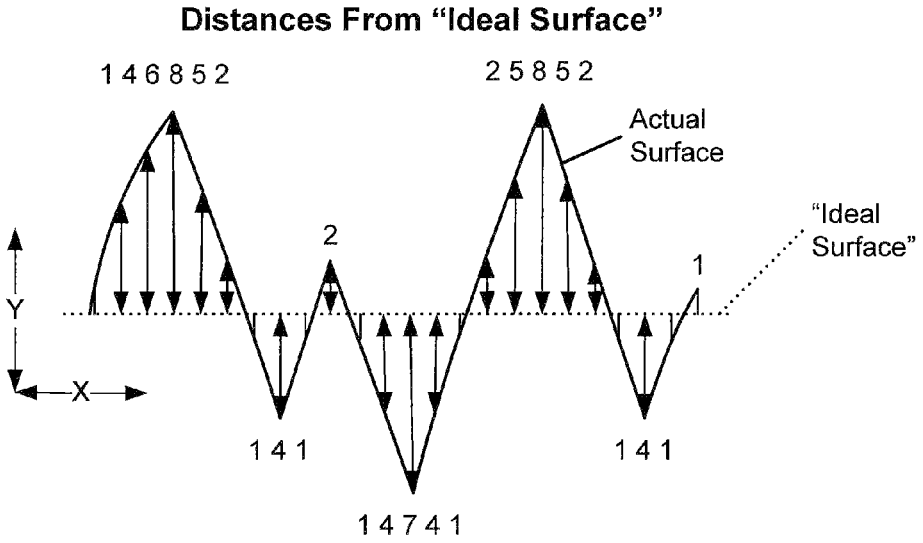
FIG. 7 is a diagram used in explaining measurement of surface roughness and deviation of an actual surface from an "ideal" surface.

Height deviation measurements may be made in any desired number and/or at any desired spacing around a ball without departing from this disclosure. FIG. 7 provides an example of the manner in which height deviation and surface roughness may be measured. In this example, while an ideal, smooth surface is illustrated (which may be flat or curved, e.g., corresponding to the curvature of a "perfect" ball or a "perfect" dimple, shown as a broken line in FIG. 7), the actual surface (the solid line) is shown to have peaks and valley's. Measurements of the actual surface location with respect to the ideal surface location are made at constant spaced distances across the desired surface area (e.g., the entire surface of the ball, at selected locations around the ball surface, within or around one or more dimples, on one or more land areas, etc.), and that measured distance corresponds to the height in the "y" direction that the actual surface deviates from the ideal surface at that specific location. Then, the sum of the absolute values for these height deviations at all measured actual surfaces is divided by the total number of measurements taken to thereby provide an average roughness value for the ball ("Ra"), e.g., as indicated from the formula above.

Appropriate measurements of the change in the surface height (e.g., height deviations) may be made using three-dimension scanning systems as are known and commercially available (e.g., a system including a Hirox OL-35011 lens, a Hirox KH-1300 microscope (available from Hirox-USA, Inc., River Edge, N.J.), a COMS Remote Controller CP-3R, Hirox KH-1300 Microscope Controller, COMS Position Controller CP-310, and a COMS CD-3R MMMB Amplifier). Such systems are capable of making three-dimensional models of an object being scanned.

As a more specific example, a three-dimension scanning system, like that described above, may be programmed to take about 4900 "pictures" around the area of a single dimple. More specifically, for a single dimple, 70 sub-pictures may be made (e.g., with a tiling factor (picture overlap) of 25%) over the surface area of the dimple (a 7×10 matrix of pictures) and its immediately surrounding area, and each sub-picture includes 70 pictures in the vertical direction (to locate the surface in the depth direction). These pictures (and subpictures) allow for computerized reconstruction of a representation of the actual dimple surface.

Another term used in this specification is called "micro surface roughness." "Micro surface roughness" is simply the Ra value described above, but only counting deviations from the ideal surface of 0.25 mm or smaller (although other cutoff values may be used without departing from this disclosure). This parameter may be referred to herein as $Ra_x$, wherein "x" represents the desired upper limit of deviation considered to constitute "micro" surface roughness. Thus, deviations from the ideal surface location of 0.25 mm or less may be referred to herein as $Ra_{0.25}$, deviations from the ideal surface of a height of 0.3 mm or less may be referred to herein as $Ra_{0.3}$, etc. Where the term micro surface roughness is used herein without a subscript it means the Ra value described above, but only counting deviations from the ideal surface of 0.25 mm or smaller. The sum of all surface roughness (e.g., with no upper limit or cut off height, with a cut off height of 80 mm, etc.) also is referred to in this specification as "macro surface roughness." Thus, "micro surface roughness" may be thought of as the portion of overall or macro surface roughness contributed by height deviations of 0.25 mm or less (or other desired upper limit, as noted above).

Any desired manner of measuring surface roughness and/or deviation of an actual surface from an "ideal surface" may be used without departing from this disclosure to determine both "macro surface roughness" and "micro surface roughness," although the three-dimensional scanning system described above was used in the tests described below. Measurements will be made over sufficient areas dispersed around the ball to provide an adequate sampling so that the determined roughness values can be statistically attributed to the entire ball. For example, in some example surface roughness measuring tests for this disclosure, the roughness of at least 7.5% of the ball's overall surface area may be measured, optionally in at least 36 discrete areas dispersed around the ball surface, and this measured surface roughness may be considered the surface roughness of the entire ball. For some measurement techniques, the discrete areas may be centered on or fully contain a dimple, and measurements may be made on at least six different dimples of each size (provided that the ball has at least six dimples of each size, and if not, all dimples of that size will be measured). The dimples measured should be dispersed around the ball (e.g., dimples on opposite sides or hemispheres of the ball) so as to provide a good overall estimate of the surface roughness.

As discussed in more detail in the parent application, at least some advantageous aspects of this disclosure may be realized for roughened balls that have at least 1.75 times the micro surface roughness ($Ra_{0.25mm}$) as the same ball construction without a roughened final coating, and in some examples, in balls having at least 2 times the micro surface roughness ($Ra_{0.25mm}$), at least 2.5 times the surface roughness ($Ra_{0.25mm}$), or at least 3 times the surface roughness ($Ra_{0.25mm}$). Notably, the ball in accordance with these aspects of the disclosure may have longer carry, a longer flight time, and a higher apex.

The golf ball body of the present disclosure has no limitation on its structure and includes a one-piece golf ball, a two-piece golf ball, a multi-piece golf ball comprising at least three layers, and a wound-core golf ball, including balls with different constructions, materials, and the like. Moreover, the present disclosure can be applied to any type of dimple pattern, including patterns with at least some non-round dimples (e.g., polygonal dimples, asymmetric dimples, dual radius dimples, etc.). The present disclosure can be applied for all types of the golf ball.

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with the figures may be used individually and/or in any combination or subcombination without departing from this disclosure.

We claim:

1. A golf ball comprising:

a core having a first density;

a cover encasing the core and including an outer surface; and a coating encasing the cover, the coating comprising:

a resin applied to the outer surface of the cover; and a plurality of particles comprising a high density material;

wherein the coating has a second density at least twice the first density; and wherein the plurality of particles are present in the coating in a sufficient amount so that an exterior surface of the golf ball has a micro surface roughness between about 1.3 μm and about 3.0 μm, and wherein micro surface roughness includes deviations from an ideal surface of 0.25 mm or less.

2. The golf ball of claim 1, wherein the high density material comprises a metal.

3. The golf ball of claim 1, wherein the plurality of particles have an average size of 400 nm to 40 μm.

4. The golf ball of claim 1, wherein the second density is at least three and a half times the first density.

5. The golf ball of claim 1, wherein the cover further includes a second plurality of particles comprising a high density material.

6. The golf ball of claim 1, wherein the core is a solid core.

7. The golf ball of claim 1, wherein the plurality of particles are contained within the resin.

8. The golf ball of claim 1, wherein the golf ball has a mass between 45.2 and 46.0 grams.

9. A golf ball comprising:

a spherical core having a first density;

a cover encasing the core and including an outer surface; and a coating encasing the cover, the coating comprising:

a resin applied to the outer surface of the cover; and a plurality of particles comprising a high density material;

wherein the coating has a second density and the coating contributes at least 0.60% of a total moment of inertia of the golf ball; and wherein the plurality of particles are present in the coating in a sufficient amount so that an exterior surface of the golf ball has a micro surface roughness between about 1.3 μm and about 3.0 μm, and wherein micro surface roughness includes deviations from an ideal surface of 0.25 mm or less.

10. The golf ball of claim 9, wherein the high density material comprises a metal.

11. The golf ball of claim 9, wherein the plurality of particles have an average size of 400 nm to 40 μm.

12. The golf ball of claim 9, wherein the coating contributes at least 0.80% of the total moment of inertia of the golf ball.

13. The golf ball of claim 9, wherein the cover further includes a second plurality of particles comprising a high density material.

14. The golf ball of claim 9, wherein the plurality of particles are contained within the resin.

15. The golf ball of claim 9, wherein the golf ball has a mass between 45.2 and 46.0 grams.

16. The golf ball of claim 15, wherein the first density is below 1.050 grams per cubic centimeter and the second density is greater than 2.5 grams per cubic centimeter.

* * * * *